PWE31 XR 4,118,763

United States Patent [19]

Osteen

[11] 4,118,763

[45] Oct. 3, 1978

[54] VARIABLE TRANSMISSION PRISMATIC REFRACTORS

[75] Inventor: Mitchell M. Osteen, Zirconia, N.C.

[73] Assignee: General Electric Company, N.Y.

[21] Appl. No.: 675,839

[22] Filed: Apr. 12, 1976

[51] Int. Cl.² ..... F21V 5/02

[52] U.S. Cl. ..... 362/339; 362/326; 362/337

[58] Field of Search ..... 240/73 LD, 78 LD, 81 LD, 240/100, 106, 106.1; 362/326, 336, 337, 339, 340

[56] References Cited

U.S. PATENT DOCUMENTS

| | | | |
|---|---|---|---|
| 124,016 | 2/1872 | Schneider | 240/106.1 |
| 1,036,527 | 8/1912 | Hewitt | 240/106 R X |
| 1,065,167 | 6/1913 | Myers | 240/100 |
| 2,175,067 | 10/1939 | Rolph | 240/106 R |
| 3,163,367 | 12/1964 | Bodian | 240/106 R |
| 3,735,124 | 5/1973 | Stahlhut | 240/106 R |

*Primary Examiner*—Fred L. Braun
*Attorney, Agent, or Firm*—Sidney Greenberg

[57] ABSTRACT

Luminaire globe has external prisms formed to provide controlled amount of emitted light in various portions of the globe. The prism comprises a combination of right angle reflecting surfaces and light transmitting surfaces contoured to provide the desired ratio of transmitted to internally reflected light.

1 Claim, 6 Drawing Figures

VARIABLE TRANSMISSION PRISMATIC REFRACTORS

The present invention relates to luminaires and more particularly to luminaires of indoor type having a globe of light transmitting prismatic type.

It is an object of the invention to provide an improved transparent reflector device constructed to provide desired amounts of reflected and transmitted light.

It is another object of the invention to provide a reflector device of the above type formed of transparent prismatic portions.

Another object of the invention is to provide a luminaire globe of the described prismatic type which produces controlled amounts of upwardly and downwardly directed light.

Still another object of the invention is to provide a luminaire globe of the above type which directs light to the desired area in a desired distribution pattern.

Other objects and advantages will become apparent from the following description and the appended claims.

With the above objects in view the present invention in one of its aspects relates to a luminaire having a globe formed of a transparent member having an inner surface and an opposite outer surface, means for mounting a light source within the globe so that light from the light source is incident on the inner surface, the outer surface of the transparent member being formed with an elongated prism having a reflecting portion for reflecting back through the inner surface a predetermined amount of the light incident on the inner surface opposite the prism and having a transmitting portion for transmitting the remainder of the incident light outwardly from the transparent member.

The invention will be better understood from the following description taken in conjunction with the accompanying drawing, in which.

Figure 1:
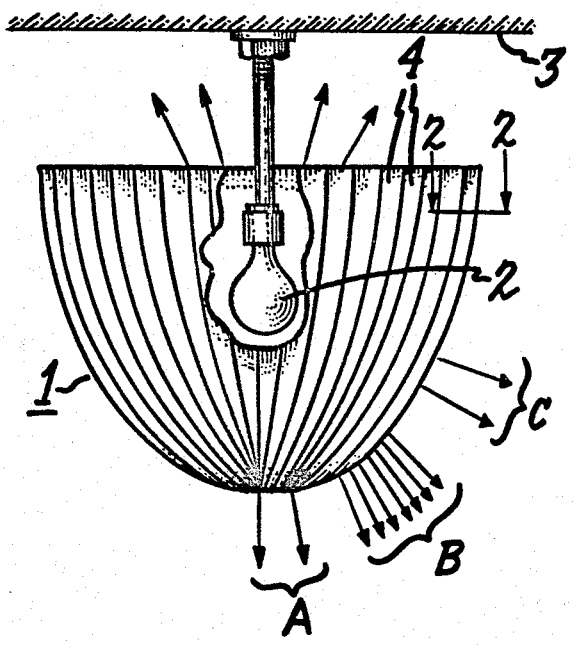
FIG. 1 is a view in elevation of an indoor luminaire having a prismatic globe embodying the invention.
Figure 2:
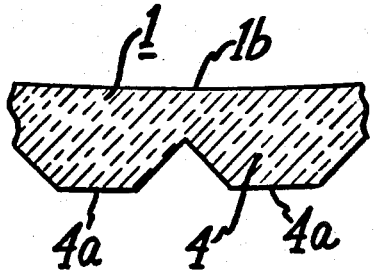
FIG. 2 is a detailed cross-sectional view in enlarged scale of a portion of the prismatic globe.

Referring now to the drawing, and particularly to FIG. 1, there is shown in somewhat diagrammatic form an indoor luminaire comprising a bowl-shaped globe 1 enclosing a lamp 2 connected to ceiling 3, the globe being suspended from the ceiling by any suitable means (not shown). Globe 1 is formed of transparent glass or plastic and has on its outer surface elongated prisms 4 extending from its open top to the bottom of the globe. In accordance with a preferred embodiment of the invention, prisms 4 each have the form of a truncated right angle prism, as shown in FIG. 2.

Figure 3:
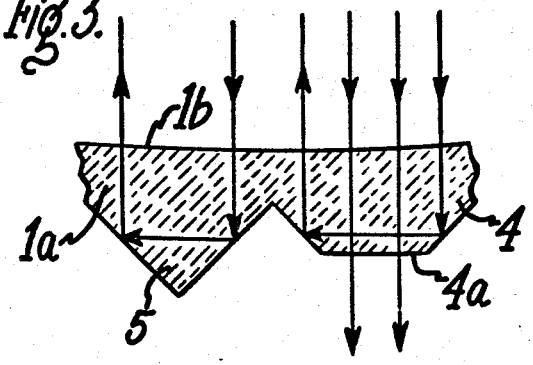
FIG. 3 is a view similar to FIG. 2 showing a comparison of a conventional reflecting prism with a prism modified in accordance with the invention, including light ray diagrams relating thereto.

As seen in FIG. 3 where the action of a conventional right angle reflecting prism 5 is compared to that of the modified prism structure 4 of the invention, the light from lamp 2 incident on the inner surface 1*b* of transparent member 1*a* opposite prism 5 is twice reflected by the angled prism surfaces and re-directed back through the inner surface, so that substantially no light is transmitted outwardly of the transparent member. By truncating the prism in accordance with the invention to provide an emitting surface 4*a* between the angled reflecting prism surfaces which is substantially parallel to the inner surface 1*b*, a portion of the incident light is permitted to pass through the outer surface in the surface region 4*a*, while the remaining portion of the incident light is reflected back through the inner surface, as indicated by the path of the light rays shown. As shown in the drawing, the light rays are incident on and reflected back through the inner surface 1*b* in substantially parallel planes. The amount of transmitted light as compared to reflected light can readily be varied by changing the ratio of surface area 4*a* to the projected area of the remaining portion of the right angle prism. Such control of the respective amounts of reflected and transmitted light can be applied to the luminaire globe shown in FIG. 1 to provide for varying ratios of such light at different vertical angles as measured from nadir. For example, as shown by the arrows in FIG. 1, the outward transmission of light may be controlled such that relatively little light emanates directly downwardly in region A, a relatively large amount of light is transmitted in region B in a range of vertical angles of, say, 30°–50°, and a relatively small amount of light is directed outwardly at higher vertical angles in region C. To produce this result, transmitting surfaces 4*a* of the modified prisms shown in FIGS. 2 and 3 would be relatively small, large and small in the respective regions of the globe in direct proportion to the desired quantity of the transmitted light. The reflected light for the most part would be directed upwardly toward the ceiling as indicated by the arrows in FIG. 1, thus providing for indirect lighting and thereby reducing contrast between the ceiling and the luminaire brightness. This reflected light has a controlled distribution determined by the contour of the bowl-shaped reflector. This contour may be varied to achieve a desired distribution of the reflected light.

As will be understood, the pattern and intensity of light distribution emanating from the luminaire may be varied as desired using the principles of the invention, merely by the extent and location of the transmitting areas provided in the right angle prism structure.

Figure 4:
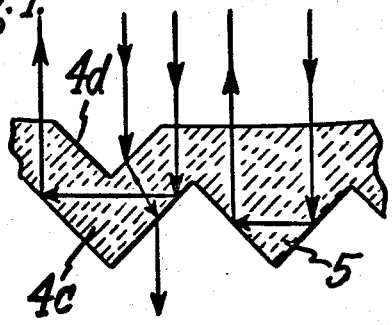
FIG. 4 is a cross-sectional view of a reflecting-refracting prism structure in accordance with a different embodiment of the invention.

FIG. 4 shows a modified form of the invention wherein the outer right angular portion of the reflecting prism is left intact but the inner surface 4*d* is grooved so that light incident thereon is refracted at both the inner and outer surfaces as shown and passes outwardly of the transparent member. Light rays which strike the flat inner surface adjacent the grooved portion are twice reflected by the right angle prism surfaces as in the previously described embodiment so as to be re-directed inwardly. Such a grooved prism structure may be found desirable where used in conjunction with fully reflecting conventional right angle prisms 5 such as shown in FIG. 4 adjacent the grooved prism 4*c*, so that a uniform appearance of the external surface of the globe may be obtained while still providing for variable light transmission in the manner described. Where refraction is relied on as shown in FIG. 4, the glass-air interface or the light path thereto should be such that the critical angle of incidence is not exceeded in areas where transmission is desired.

Figure 5:
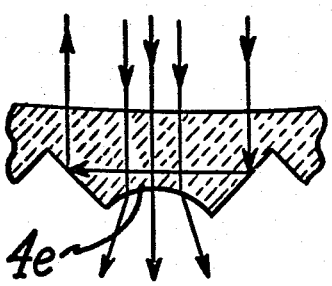
FIGS. 5 and 6 are cross-sectional views of modified forms of the prism structure of the invention.

FIG. 5 shows a modification of the invention wherein the outer light transmitting surface 4*e* of the right angle prism is in the form of a concave light-spreading lens whereby the transmitted light is dispersed so as to blend the light with light emanating from adjacent prisms. In this way, increased diffusion of the light may be achieved.

Figure 6:
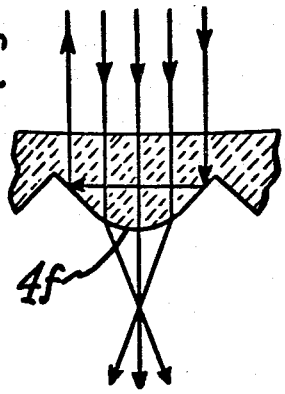

In the FIG. 6 embodiment, the outer prism surface 4*f* is in the form of a convex condensing lens for converging the light rays passing therethrough, and also thereby causing a spreading of the light rays in the manner shown.

As will be understood, other contours may be employed for the emitting surface instead of the particular lens contours shown in FIGS. 5 and 6 to achieve the desired distributions of light, including a suitable combination of contours for that surface.

By virtue of the invention, a single optical device serves the functions of both light reflection and light transmission in controlled manner, and makes possible brightness and photometric distribution capabilities not obtained with conventional reflectors or refractors employed individually.

As used herein, the expression "right angle prism" is intended to refer to conventional right angle reflecting prisms composed of glass or plastic having the usual index of refraction for reflecting prisms and wherein the right angle has a tolerance of plus or minus 5°.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A luminaire comprising, in combination, a bowl-shaped globe of light transmitting material having an open top and inner and outer surfaces, a light source arranged within said globe so that light rays therefrom are incident on the inner surface of said globe, the outer surface of said globe being formed with a plurality of elongated prisms extending between the top and bottom of said globe, each said prism having a reflecting portion for reflecting a predetermined amount of said incident light back through said inner surface and having a transmitting portion for transmitting the remainder of said incident light outwardly from said globe, at least certain of said elongated prisms having reflecting portions and transmitting portions of different relative areas along the prism length.

* * * * *